US005327682A

United States Patent [19]

Holtz

[11] Patent Number: 5,327,682

[45] Date of Patent: Jul. 12, 1994

[54] ACCESS PANEL HAVING REMOVABLE DOOR AND RECESSED HINGE

[75] Inventor: Claudia P. Holtz, Forest Hills, N.Y.

[73] Assignee: Karp Associates, Inc., Maspeth, N.Y.

[21] Appl. No.: 30,655

[22] Filed: Mar. 12, 1993

[51] Int. Cl.[5] ..... E06B 3/32

[52] U.S. Cl. ..... 49/463; 16/361; 49/397; 49/398; 49/400

[58] Field of Search ..... 49/463, 466, 465, 398, 49/397, 400; 16/357, 361

[56] References Cited

U.S. PATENT DOCUMENTS

| | | | |
|---|---|---|---|
| 1,044,383 | 11/1912 | Hatch . | |
| 1,335,999 | 4/1920 | Stover | 16/361 |
| 1,651,941 | 12/1927 | Ashkenas . | |
| 1,818,269 | 11/1931 | Olley . | |
| 2,532,714 | 7/1944 | Huyssen . | |
| 2,623,249 | 12/1952 | Miller . | |
| 2,766,856 | 10/1956 | Nelsson | 49/465 X |
| 2,793,721 | 6/1957 | Sterud . | |
| 3,130,651 | 4/1964 | Werner | 49/400 |
| 3,286,405 | 11/1966 | Schembri . | |
| 3,491,486 | 1/1970 | Caruth | 49/463 |
| 3,537,212 | 11/1970 | Gilles | 49/465 X |
| 3,817,601 | 6/1974 | Colaiace et al. . | |
| 4,478,005 | 10/1984 | Mundschenk | 49/397 X |
| 4,601,528 | 11/1986 | Spier . | |
| 4,692,838 | 9/1987 | Merchant | 16/361 X |
| 4,890,418 | 2/1990 | Sachs . | |
| 5,065,842 | 11/1991 | Nahar | 49/463 X |

FOREIGN PATENT DOCUMENTS

| | | | |
|---|---|---|---|
| 400065 | 10/1933 | United Kingdom | 16/357 |

*Primary Examiner*—Philip C. Kannan
*Attorney, Agent, or Firm*—David M. Klein; Bryan Cave

[57] ABSTRACT

An access panel assembly for providing access to the interior of a wall is disclosed. The panel is made of a molded plastic, such as a styrene polymer. The door is press-fit and is held in the frame by grooves in the frame which align with resilient proturbences on the door panel. A hidden hinge, which allows the door to be hinged or removed from the frame, is provided. A pair of eccentric cavities serves to provide pivot points for the hinge and engage with hinge pivots on the access door. In this hinge, the pivot point may vary, thereby preventing jamming of the door. A notch is formed in the eccentric cavity to allow removal of the door. Pry holes are provided to assist in removal of the door. An embodiment is disclosed which permits the hinged door to be flush mounted from either side of the frame.

5 Claims, 2 Drawing Sheets

ACCESS PANEL HAVING REMOVABLE DOOR AND RECESSED HINGE

BACKGROUND OF THE INVENTION

1. Field of the Invention

The present invention relates generally to access doors, and more particularly to an access door having a press-fit flush mounted door with a recessed hinge.

2. Description of the Prior Art

Panels for accessing the interior of a wall are readily known in the art. Such panels typically have a frame, which is affixed in the wall, and a removable door panel.

For example, Olley, U.S. Pat. No. 1,818,269, discloses an access panel and a cover plate therefor. A flange is provided as part of the frame, and is mounted on the inside of the wall. A cover plate, which is secured by screws, is provided for covering the opening in the wall.

In order to make a door panel removable while overcoming the inconvenience of using screws to secure the door, other prior art devices employ a resilient member for securing the door in the frame. When it is desired to remove the door from the frame, outward pressure is applied to the door to bias the resilient members and to release the door from the frame.

For example, Hatch, U.S. Pat. No. 1,044,383 discloses a door having removable panels. Each panel includes a groove in which fits a rod mounted on the door. The rod is resilient and snaps into the groove when the panel is inserted. After the rod enters the groove, the panel is securely held into the frame.

Sachs, U.S. Pat. No. 4,890,418 discloses an access panel having a press-fit door. The frame includes a shallow groove on its inner edge. The press-fit door has resilient proturbences which engage the groove to secure the door in the frame but allow removal of the door.

Generally, access panel frames include a wide edge, which is mounted on the exterior of the wall, and a narrow edge, which faces the inside of the wall. Other access panel have been developed in which the wide edge is located within the wall, or in which the frame is reversible. In a reversible configuration, the door may be mounted in either face of the frame.

For example, Huyssen, U.S. Pat. No. 2,352,714 discloses an access panel wherein the wide edge of the frame is mounted on the inside of the wall. Huyssen further discloses flush-mounting the door on the outer edge of the frame.

Sterud, U.S. Pat. No. 2,793,721 and Sachs, U.S. Pat. No. 4,890,418 disclose other access doors wherein the door may be mounted on either face of the frame.

Other prior art devices employed a fixed hinge which attached the door to the frame rather than making the door panel removable. However, none of these prior art devices disclose an access panel having a door which hinges to allow the door to be opened and closed while still allowing the door to be removed. Furthermore, none of the prior art devices which employ a reversible door discloses the use of a hidden hinge in the panel which allows the door to be installed in, removed from, and hinge while mounted in, either face of the frame.

SUMMARY OF THE INVENTION

The present invention is an access panel assembly for providing easy access to fixtures located within a wall.

The access panel is preferably constructed of a molded plastic, such as a styrene polymer, and includes a press-fit door. The press-fit door and frame include a hidden hinge which allows the door to be swung open for access through the wall panel. Alternatively, the door may be completely removed from the frame. The door of the access panel is surface mounted to the frame.

A pair of shallow grooves is disposed along the inner face of the frame. The grooves engage with resilient members on the door and allow the door to be removably secured to the frame. Pry holes to assist in removal of the door may be included, if desired.

The design of the present invention is similar to prior access doors, except that the present invention includes a flush-mount, press-fit door, and a hidden hinge to allow the door to open and close while not hindering removability. In order to allow the access door to be hinged a pair of eccentric cavities serve as pivot points on the frame. These engage with hinge pivots on the access door. This novel hinge allow the pivot point of the hinge to shift to prevent jamming of the door.

The outward facing side of each eccentric cavity is partially cut away to form a notch. This notch allows the door to be removed from the frame by removing the hinge pivots from the cavities.

In an alternative embodiment, the present invention may be modified to provide an access door in which the door may be flush mounted from either side. In this embodiment, the inward side of the eccentric cavity is cut away to form a second, inward facing notch, which allows the door to be press-fitted from either side, and hinged from either side.

DESCRIPTION OF THE PREFERRED EMBODIMENT

Figure 1:
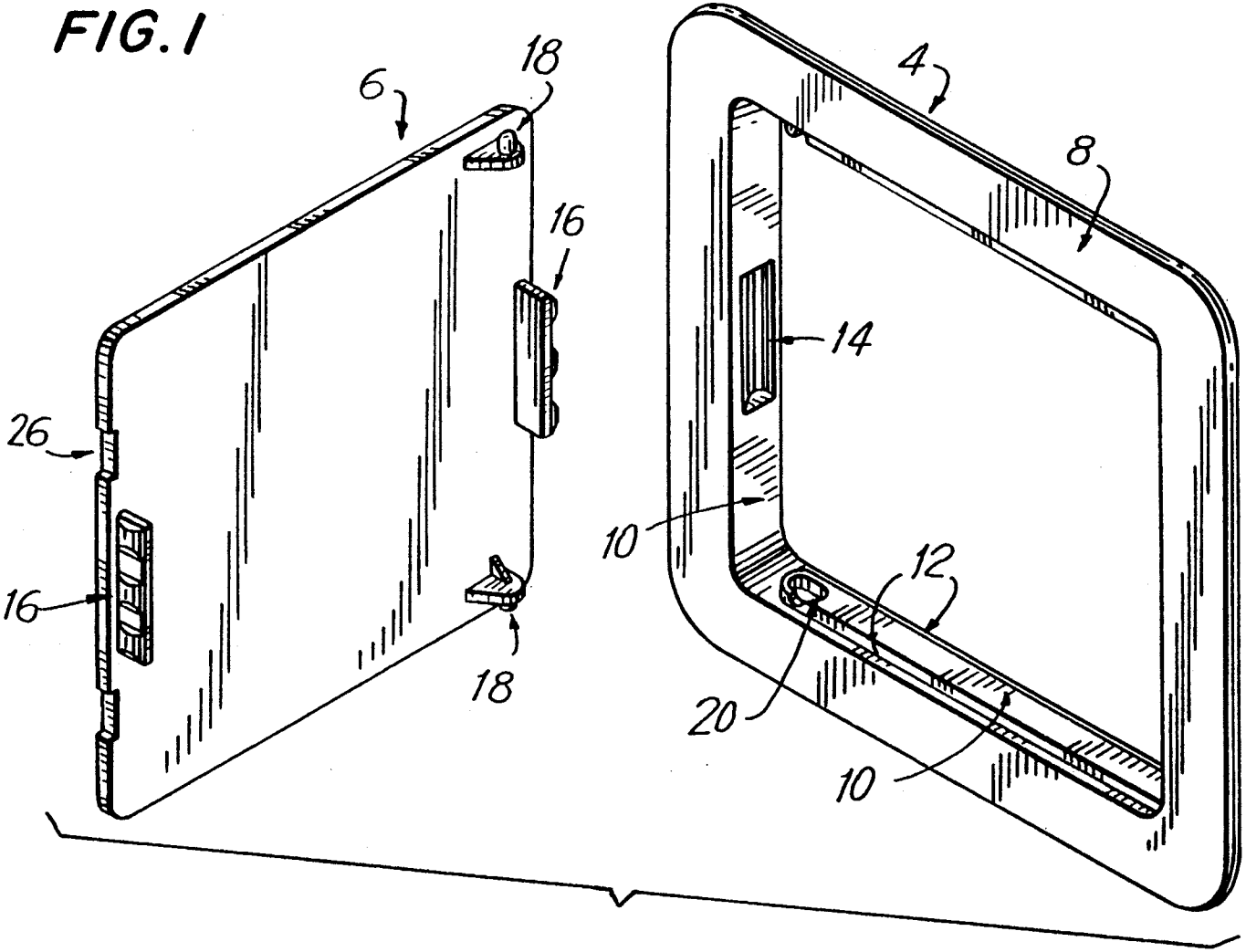
FIG. 1 shows a perspective view of the access panel of the present invention.
Figure 2:
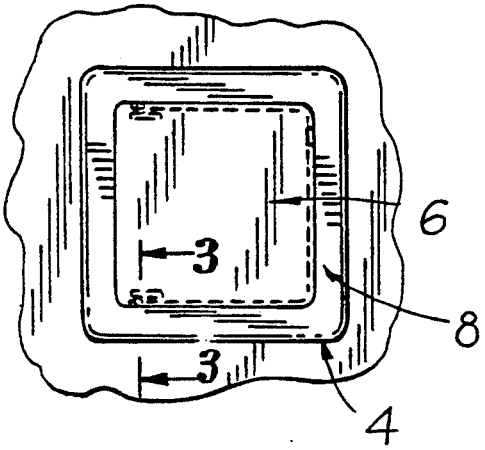
FIG. 2 shows a front view of the access panel frame of the present invention mounted in a wall.

The present invention is an access panel which may be mounted in the surface of a wall to allow access to the interior of the wall. As shown in FIGS. 1 and 2, the access panel includes frame 4 which is installed in the wall and a removable access door 6 which is preferably press-fit and hinged in frame 4 to allow access to the interior of the wall, as described below.

Frame 4 preferably includes an outer face 8 which defines a first opening into which access door 6 is insertable. Outer face 8 preferably extends outward of the opening and helps to secure the frame to the wall, in addition to serving an aesthetic purpose.

Frame 4 also includes an inner face 10. Inner face 10 includes a raised portion which defines a smaller inner opening. The raised portion does not extend entirely around the opening so as to allow the hinge mechanism to operate, as described below. The difference in size between the inner and outer openings forms a support edge 12. Access door 6 is preferably sized to be insertable in frame 4 flush with the surface of outer face 8, with support edge 12 preventing further inward movement of access door 6.

As shown in FIG. 1, a pair of shallow grooves 14 is centrally disposed along inner face 10. Grooves 14 engage with corresponding resilient members 16 on access door 6 to removably secure access door 6 in frame 4. Thus, door 6 may be securely mounted to frame 4 by aligning the engaging member 16 with the grooves 14 and pressing the door into the frame. If desired, grooves 14 need not be centrally disposed along inner face 10, provided that the resilient members 16 on access door 6 are modified accordingly to engage grooves 14.

Access door 6 is preferably substantially flat, although the access panel may readily be modified to a rounded or other shape configuration. Pry holes 26 are notched into the door panel to allow a screwdriver or other device to be used to pry the access door 6 from frame 4 if it is desired to remove or open the door.

Figure 3:
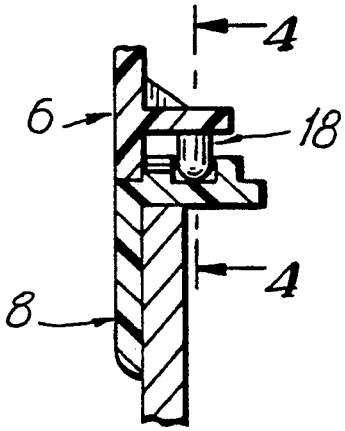
FIG. 3 shows a cross-sectional view of the hinge mechanism of the present invention through Section 3—3.
Figure 4:
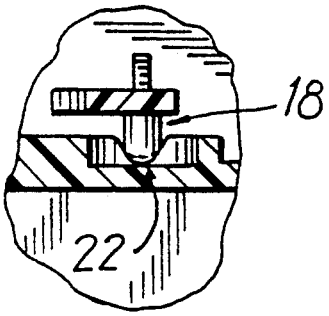
FIG. 4 shows a cross-sectional view of the hinge mechanism of the present invention through Section 4—4.

As shown in FIGS. 1, 3 and 4, in order to allow the access door 6 to be hinged open and closed, frame inner face 10 includes a pair of eccentric cavities 20 which serve as pivot points for corresponding resilient hinge pivots 18 on access door 6. While typically a hidden hinge would pivot around a fixed point, it has been found that the flush mount door of the present invention would jam against the frame when the hinge is operated if the pivot point were fixed. The eccentric cavities as described herein, permit the pivot point of the hinge to move relative to the frame, and allow the door edge to be moved away from the frame when the door is opened, thereby preventing jamming of the door.

The outward facing side of each eccentric cavity 20 is partially cut away to form notch 22. When it is desired to remove the door 6 from the frame, hinge pivots 18 are aligned with notches 22 and outward pressure is applied to the door 6. If the hinge pivots 18 are not aligned with the notches 22, the door will remain secured in cavity 20. Due to the resiliency of the materials, this outward pressure will cause the door to be removed from the frame. Reinstallation of the door is the reverse of removal. The hinge pivots 18 are aligned with the notches 22 of cavities 20 and pressure is applied to the door until the pivots 18 are pressed into cavities 20. Since the notches only partially cutaway the sides of cavity 20, once the door is inserted into the cavity it cannot simply fall out of the cavity. Rather, a sufficient pressure is necessary to bias the resilient material enough to permit the hinge pivot to be removed from the cavity. It should be understood that if one of the two hinge pivots is removed from its cavity through a notch, the door will release from the frame and it is not necessary to remove the second hinge pivot through its respective notch. It is foreseen that the presently described hinge mechanism may be employed in other types of doors or equipment.

Figure 5:
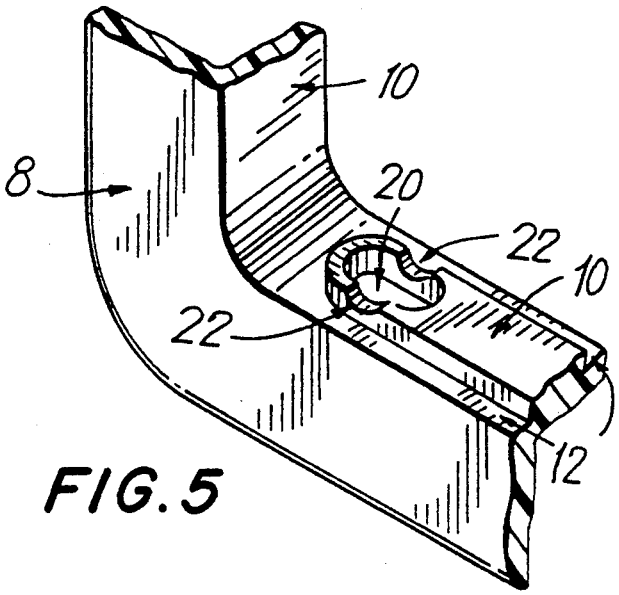
FIG. 5 shows an exploded view of the eccentric cavity of the hinge mechanism of the present invention in a reversible door configuration.

In an alternative embodiment, the present invention may be modified to provide an access door wherein the door may be flush mounted from either side, such as described in Sachs, U.S. Pat. No. 4,890,418. In this embodiment, a second support edge would be provided on the inner side of the opening to allow the door to be mounted on that side. Unlike the Sachs device, the inner and outer support edges of the present invention do not extend entirely around the opening. Rather, part of the edges is cut away to allow the hinges to operate, as previously shown and described. As shown in FIG. 5, in this embodiment, the inward side of the eccentric cavity is also cut away to form a second, inward facing notch which allows the door to be press-fitted from either side, and hinged from either side.

The door 6 and frame 4 of the present invention are preferably constructed of a high-impact styrene polymer. It is foreseen that other materials exist from which the access panel of the present invention may be constructed. Access door 6 and frame 4 and their various components as previously described are preferably integrally molded. However, the various components may be assembled rather than molded, if desired.

Although the present invention has been described in detail with respect to certain embodiments and examples, variations and modifications exist which are within the scope of the present invention as defined in the following claims.

What is claimed is:

1. In an improved access panel for mounting in a wall and for enabling access to the interior of said wall, said access panel comprising:

a frame comprising an outer face for engaging said wall for preventing movement of said frame in said wall, and an inward facing edge integral with, and substantially perpendicular to, said outer face, said inward facing edge defining an opening for accessing the interior of said wall; and a press-fit door sized to correspond to said opening and being removably insertable therein;

wherein the improvement comprises:

said inward facing edge further comprising an eccentric cavity for providing a hinge pivot point, said eccentric cavity comprising walls for providing a guide track for allowing movement of said hinge pivot point along said guide track, said walls further comprising a notch disposed therein toward said outer face for enabling removal of said door from said cavity; and said door further comprising a hinge pivot being alignable with said notch and being movable into and out of said eccentric cavity through said notch in direct response to an applied pressure when said hinge pivot is aligned with said notch, said door being secured in said eccentric cavity absent said applied pressure and said alignment for enabling said pivot point to move along said cavity, said hinge pivot and said eccentric cavity cooperating to form a hinge having a movable pivot point for said secured door in said eccentric cavity, said hinge both allowing opening and closing of said secured door in said frame and removal of said door from said frame.

2. An improved access panel according to claim 1 wherein said inward facing edge further comprises a groove, and said door further comprises a resilient member, said groove and resilient member cooperating to removably secure said door to said frame.

3. An improved access panel according to claim 1 wherein said door further comprises a pry notch for allowing easier removal of said door from said frame.

4. An improved access panel according to claim 1 wherein said door is substantially flush with said outer face.

5. An access panel according to claim 1 further comprising:

securing means in said door and said frame for allowing said door to be flush-mounted in said frame from either side of said opening; and said eccentric cavity walls further comprising a second notch facing away from said outer face to allow said hinge pivot to be inserted and removed from said eccentric cavity under said pressure from either side of said opening, and thereby allowing said door to be openable and closeable when mounted on either side of said opening.

* * * * *